United States Patent [19]

Sammis

[11] 4,149,113

[45] Apr. 10, 1979

[54] D. C. POWERED CONTROL CIRCUIT FOR ENERGIZING A COLD CATHODE LAMP

[75] Inventor: John C. Sammis, El Monte, Calif.

[73] Assignee: Decor Design Corporation, Los Angeles, Calif.

[21] Appl. No.: 859,310

[22] Filed: Dec. 12, 1977

[51] Int. Cl.[2] ..... H05B 37/02; H05B 41/30

[52] U.S. Cl. ..... 315/219; 315/209 R; 315/287

[58] Field of Search ..... 315/219, 223, 206, 209 R, 315/287, DIG. 5, DIG. 7

[56] References Cited

U.S. PATENT DOCUMENTS

| | | | |
|---|---|---|---|
| 3,882,357 | 5/1975 | Nieuweboer et al. | 315/219 X |
| 4,087,722 | 5/1978 | Hancock | 315/DIG. 7 |

*Primary Examiner*—Alfred E. Smith
*Assistant Examiner*—Charles F. Roberts
*Attorney, Agent, or Firm*—Christie, Parker & Hale

[57] ABSTRACT

A control circuit including digital circuitry and a voltage step up transformer is arranged to operate as an inverter to provide for energizing a cold cathode lamp under power provided by a d.c. source such as a battery. According to a significantly preferred feature, any one of a plurality of operating modes can be manually selected so that different illuminating effects can be provided as desired.

5 Claims, 3 Drawing Figures

D. C. POWERED CONTROL CIRCUIT FOR ENERGIZING A COLD CATHODE LAMP

BACKGROUND OF THE INVENTION

In general, this invention relates to circuitry for energizing a cold cathode lamp. More particularly, it relates to a control circuit having d.c. powered digital circuits for causing the cold cathode lamp to repeatedly reignite at a pulse repetition frequency defined by a control signal output of the control circuit.

Cold cathode lamps are well known in the art. They are used in various ways including advertising signs and decorative devices. A cold cathode lamp includes an elongated tube that is formed into a desired shape to define a design. In some circumstances it is desirable to have the lamp provide steady illumination. In others, it is desirable to produce other kinds of illumination effects involving perceptible variations in light intensity produced by the lamp.

Some such lamps are mercury filled, and others are of the neon type which include a trace of argon. A characterizing electrical feature of any such cold cathode lamp is that it defines a negative resistance load after it is initially fired. That is, a relatively high voltage appears across the lamp input terminals and relatively low current flows therebetween when the lamp initially fires. Then, as additional drive current flows, the magnitude of the drive voltage decreases. Such lamps are made in various sizes and have various different ratings as to triggering voltage and sustaining voltage. The longer the lamp is made, the higher these rating voltages become, with a typical constant of proportionality for sustaining voltage being about 100 volts per foot.

A conventional arrangement for energizing a cold cathode lamp is referred to as a ballast circuit, and is designed in such a way as to be compatible with the negative resistance load presented by the cold cathode lamp. A characterizing feature of an inverter ballast for driving a cold cathode lamp is that the interconnected inverter ballast and cold cathode lamp define a self-oscillating circuit. There are significant shortcomings involved in such an overall self-oscillating circuit. Among these shortcomings is an important one relating to intensity control. As stated above, it is desirable to provide for such intensity control to make possible various types of illuminating effects. Prior attempts to meet this objective have involved amplitude control over supply voltage, which has been found to be an unsatisfactory approach.

SUMMARY OF THE INVENTION

The present invention is directed to a d.c. powered control circuit for energizing a cold cathode lamp. A control circuit embodying the present invention is simple in construction and provides significant operating advantages particularly with respect to intensity control. With a control circuit embodying the present invention being included therein, a sign or decorative device can provide a desired illumination level, and, in accordance with a particularly important preferred feature of the invention, a plurality of different operating modes are selectable so that a single sign or decorative device can provide different illuminating effects.

Briefly, the control circuit has an input for application of d.c. power. This provides for the connection of the control circuit to an external d.c. source such as a battery. Circuit means in the control circuit respond to d.c. power applied to the input to generate a periodic signal. In an operating mode of the control circuit according to this invention, the periodic signal defines a fundamental frequency of operation. Each cycle of the periodic signal during such operating mode includes a pulsing phase and a static phase. The circuit means includes digital circuit means operative during the pulsing phase to cause the periodic signal to define a plurality of consecutive pulses at a frequency substantially higher than the fundamental frequency. The control circuit further has an output for connection to the cold cathode lamp, and voltage step-up transformer means coupled between the circuit means and the output. In operation, there is provided a control signal from the transformer means to cause the cold cathode lamp to repeatedly reignite during the pulsing phase.

The preferred embodiment of the present invention is a multi-mode d.c. powered control circuit. The preferred embodiment includes manually operable mode selecting means to provide for selecting between a plurality of different operating modes. In the circuit means which responds to d.c. power applied to the input, there are included first and second astable multivibrator circuits. The first astable multivibrator circuit is controllable in response to a gating control signal supplied by the second astable multivibrator circuit. The second astable multivibrator circuit in turn is responsive to the mode selecting means such that in a first one of the operating modes the gating control signal has a constant waveform, and such that in each other operating mode the gating control signal has a pulse waveform with a pulse repetition frequency unique to the respective operating mode. The first astable multivibrator circuit is operative during the first operating mode under control of the constant waveform to cause the periodic signal to have a preselected pulse repetition frequency. In each other operating mode, the first astable multivibrator circuit is operative under control of the respective pulse waveform to cause the periodic signal to define a fundamental frequency with a pulsing phase and a static phase. During the pulsing phase, there are produced a plurality of consecutive pulses at the preselected pulse repetition frequency, and the pulsing and static phases alternate at the same fundamental frequency of the waveform defined by the gating control signal.

Other important preferred features of the invention and the advantages thereof are described in detail below and recited in distinguishing features of the appended claims.

DETAILED DESCRIPTION

Figure 1:
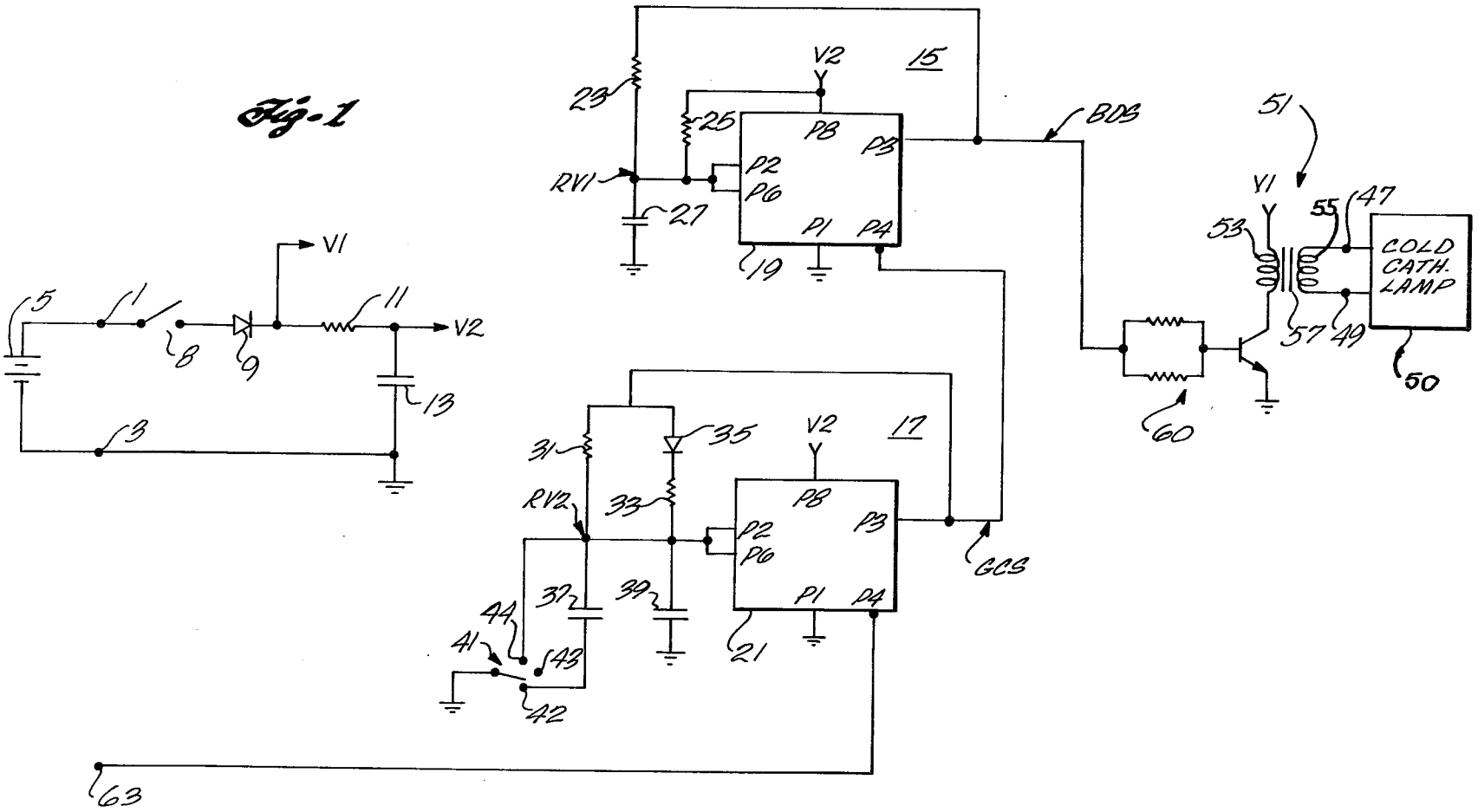
FIG. 1 is a block and schematic diagram of a control circuit embodying the present invention.

With reference to FIG. 1, terminals 1 and 3 constitute an input to provide for application of d.c. power from an external d.c. source such as a 12-volt battery 5. A manually controlled on/off switch 8 is connected to terminal 1, and terminal 3 is connected by wires not shown to each of the other points indicated by a ground symbol.

As a safety precaution taken in view of the possibility that someone might inadvertently reverse the polarity of the applied d.c. power when connecting battery 5 to the input, there is provided a diode 9 in series with the normally opened contact of switch 8. A low-pass filter is provided, the filter comprising resistor 11 and capacitor 13 which are connected in series between the cathode of diode 9 and ground. The junction of resistor 11 and capacitor 13 is connected by wires not shown to each of the other points indicated by the symbol V2. The cathode of diode 9 is connected by a wire not shown to the point indicated by the symbol V1. Suitably, resistor 11 is a 100 ohm resistor, and capacitor 13 is a 20 microfarad capacitor.

A pair of digital circuits generally indicated at 15 and 17 receive d.c. power when switch 8 is closed to its ON position. Each of these digital circuits includes in the preferred embodiment an integrated circuit (19 and 21) of the type sold by various semiconductor manufacturers under the designation 555 Timer. One such semiconductor manufacturer is Raytheon Semiconductor. Integrated circuits 19 and 21 are each depicted in block diagram form, and the reference characters such as P1, P2, etc. which appear within the blocks identify 555 Timer pin numbers used by various semiconductor manufacturers to designate terminals in accordance with a convention followed to enable interchangeable use of the timers made by different manufacturers.

Terminals P8 and P1 of a 555 Timer are input terminals which receive d.c. operating power. Terminals P2, P6, and P4 are commonly referred to respectively as a trigger input, a threshold input, and a reset input. Terminal P3 is the output terminal of the integrated circuit.

The pertinent characteristics of a 555 Timer are as follows. On its output terminal P3, it produces a binary valued signal that is either high (i.e., approximately equal to the potential appearing on terminal P8), or low (i.e., approximately equal to the potential appearing on terminal P1). With the trigger (P2) and threshold (P6) inputs being connected together, whenever the potential appearing on these interconnected inputs is less positive than one-third of the d.c. supply voltage, the binary valued signal is high. Whenever the potential appearing on these interconnected inputs is more positive than two-thirds of the d.c. supply voltage, the binary valued signal is low. As for the region between one-third and two-thirds of the supply voltage, the 555 Timer exhibits memory and the binary valued signal may be either high or low depending on recent history.

Figure 2:
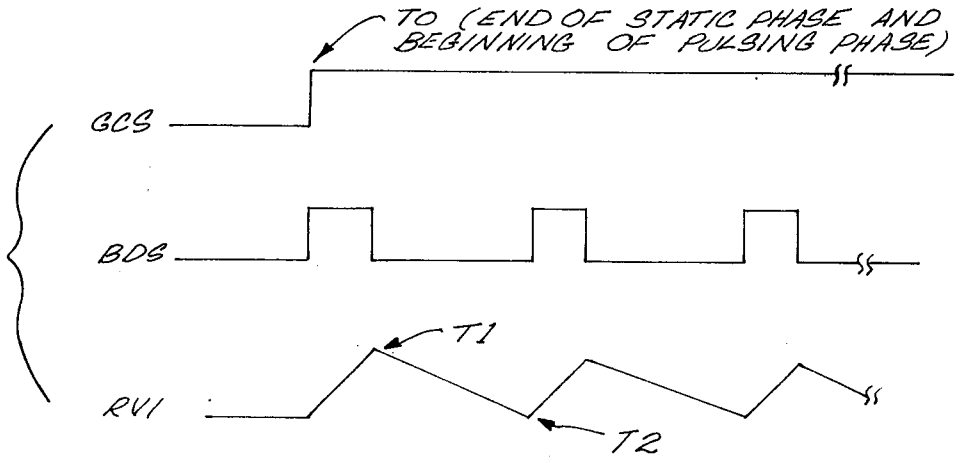
FIG. 2 comprises a group of timing diagrams depicting various signal waveforms illustrating the manner in which a first astable multivibrator circuit of FIG. 1 is controlled by a gating control signal.

In addition to integrated circuit 19, digital circuit 15 includes a pair of resistors 23 and 25 and a capacitor 27. As arranged, digital circuit 15 constitutes a controllable astable multivibrator circuit having a gating control input at P4 for receiving a gating control signal GCS, and having a multivibrator circuit output at P3 where there is produced a buffer drive signal BDS. With reference to FIG. 2, there will now be explained the manner in which digital circuit 15 responds to a gating control signal GCS.

In the timing diagram of FIG. 2, GCS has a low binary value prior to a time T0 and has a high binary value after time T0. While GCS is low, digital circuit 15 is in an externally forced reset state such that BDS has a static, low value. Under circumstances such that BDS has been low for a time period that is relatively long in comparison with a time constant defined by resistors 23 and 25, and capacitor 27, a signal RV1 (an acronym for ramp voltage 1) it is at a lower target level. The relative values of resistors 23 and 25 are such that the lower target level is somewhat less positive than one-third of the voltage V2. Suitable values are 100k ohms for resistor 25 and 39k ohms for resistor 23. When at time T0, the binary value of GCS changes from low to high, digital circuit 19 is immediately triggered owing to the relatively low prevailing level of RV1, and BDS changes from low to high. Capacitor 27 then begins to receive charging current, and the level of RV1 increases from its lower target level toward an upper target level, viz, V2, at a rate which is a function of the above-mentioned time constant.

In the course of charging toward the upper target level, the level of RV1 reaches the threshold of two-thirds of V2 at time T1, and digital circuit 19 changes state with the result that BDS changes from a high to a low level. At this point, capacitor 27 begins to discharge, and the level of RV1 decreases from the threshold level toward the lower target level at a rate which is also a function of the above-mentioned time constant. In the course of discharging toward the lower target level, the level of RV1 drops to the trigger level of one-third of V2 at time T2, and digital circuit 19 changes state with the result that BDS changes from a low to a high level.

The positive pulse defined between T0 and T1 has a shorter duration than the pulse-spacing time from T1 to T2. With capacitor 27 having a suitable value such as 680 picofarads, and with resistors 23 and 25 having the suitable values given above, the positive pulse has a pulse width of approximately 13 microseconds, and the pulse spacing time is approximately 37 microseconds. Accordingly, digital circuit 15, while it receives a high level GCS, it is operative to cause BDS to have a pulse repetition frequency of approximately 20k pps. On the other hand, while it receives a low-level GCS, digital circuit 15 causes GCS to have a static, low value.

With reference again to FIG. 1, digital circuit 17, in addition to integrated circuit 21, includes resistors 31 and 33, a diode 35, and capacitors 37 and 39. A single-pole, three-position switch 41 having switch contacts 42, 43 and 44 is connected to digital circuit 17. Switch 41 constitutes a manually operable selecting means to provide for selecting between a plurality of different operating modes. To place the control circuit in an operating mode referred to herein as a flash mode, switch 41 is placed in its illustrated position such that switch contact 42 is grounded. Switch contact 42 is connected to one end of capacitor 37. While the control circuit is in a flash operating mode, capacitor 37 is connected in parallel with capacitor 39. To place the control circuit in an operating mode referred to herein as a strobe mode, switch 41 is placed in a position such that switch contact 43 is grounded. To place the control circuit in another operating mode referred to herein as a steady illumination mode, switch 41 is placed in a position such that switch contact 44 is grounded. Switch contact 44 is connected to, among other things, the interconnected trigger and threshold inputs of circuit 21.

While the steady illuminatin mode is being selected, the coupling of the ground level to the interconnected trigger and threshold inputs of circuits 17 causes GCS to remain constant at its high level. As described above, during a period in which GCS is high, digital circuit 15 causes BDS to have a preselected pulse repetition frequency.

Figure 3:
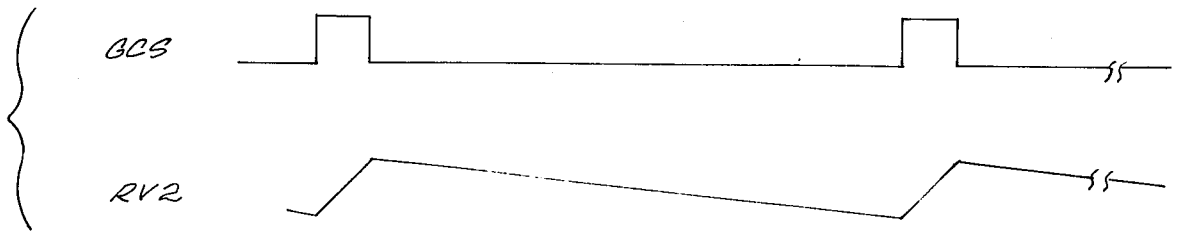
FIG. 3 comprises a group of timing diagrams depicting varius signal waveforms illustrating the manner in which a second astable multivibrator circuit of FIG. 1 produces the gating control signal during operating modes involving variations in the intensity of the illumination provided by a cold cathode lamp controlled by the control circuit of FIG. 1.

In each other operating mode, digital circuit 17 operates as an astable multivibrator circuit causing GCS to have a pulse waveform such as that depicted in FIG. 3. In the flash mode, the pulse repitition frequency of GCS is preferably in the order of about 0.6 to 0.8 pps. In the strobe mode, the pulse repetition frequency is about 10 times higher. In either of the operating modes, the pulse waveform is substantially asymmetrical in that the pulse width of the positive pulse is about one tenth the duration of time between pulses. Suitable values for the pertinent components are 2 microfarads for capacitor 39, 20 microfarads for capacitor 37, 10k ohms for resistor 33 and 100k ohms for resistor 31.

As illustrated in FIG. 3, during each positive pulse, a signal RV2 defines a ramp having a positive slope. During this time, diode 35 is forward biased and the pertinent time constant is determined by the resistance value of the parallel combination of resistors 31 and 33 multiplied by the capacitance value of either capacitor 39 (during the strobe mode) for the parallel combination of capacitors 37 and 39 (during the flash mode). On the other hand, during the time between positive pulses, diode 35 is reversed biased, with the result that only resistor 31 rather than the parallel combination of resistors provides a discharge path. Owing to the consequent differences in time constants, the time for discharging from the threshold level to the trigger level is longer than the time for charging from the trigger level to the threshold level.

In summary of the foregoing, digital circuits 15 and 17 cooperate to define a circuit means responsive to applied d.c. power for generating a periodic signal BDS that has a different fundamental frequency of operation in each of the plurality of operating modes. In one of the operating modes, digital circuit 17 causes GCS to have a constant waveform and digital circuit 15 causes BDS to have a continuously pulsing waveform with a preselected pulse repetition frequency such as about 20k pps. In each of the other operating modes, digital circuit 17 causes GCS to have a pulse waveform having a pulse repetition frequency unique to that operating mode, and digital circuit 17 is operative in each such other operating mode under control of GCS to cause the periodic signal BDS to define a fundamental frequency with a pulsing phase and a static phase. The periodic signal defines during the pulsing phase a plurality of consecutive pulses at the above-mentioned preselected pulse repetiton frequency, and its pulsing and static phases alternately occur at the same fundamental frequency as the pulse repetition frequency of the waveform GCS. In an embodiment wherein the fundamental frequency is 7 Hz during the strobe mode, the duration of each pulsing phase is approximately 13 milliseconds during which approximately 260 consecutive pulses are defined by BDS, and the duration of each static phase is approximately 130 milliseconds.

With reference again to FIG. 1, the control circuit further includes terminals 47 and 49 which constitute a control circuit output for connection to an external cold cathode lamp 50. A voltage step-up transformer generally indicated at 51 is coupled between the circuit means and the output for providing a control signal to cause the cold cathode lamp to repeatedly reignite at the preselected pulse repetition frequency. As to the transformer used in the preferred embodiment, a primary winding 53 has 11 turns of #20 wire, a secondary winding 55 has 900 turns of #40 wire, and a core 57 is a ferrite core sold by TDK Electronics under the designation GE7-E30. The transformer bobbin is also a standard component sold by TDK Electronics, under the designatin BE30-118T.

A transformer so constructed is suitable in circumstances in which cold cathode lamp 50 is approximately seven to eight feet long and thereby requires approximately 1,000 volts peak to peak as a sustaining voltage. As mentioned above, the cold cathode lamp has a negative resistance characteristic. The load it presents prior to firing is primarily capacitive. Transformer 51 tends to ring when it drives such a capacitive load, and thus the peak-to-peak voltage developed across terminals 47 and 49 when switch 8 is first closed is approximately 2,500 volts peak-to-peak with a very sharp rise time. This initial voltage is sufficiently high to ensure that the lamp fires quickly. Then, as lamp 50 draws higher amounts of current, the voltage across it decreases until the voltage stabilizes at a value somewhere in excess of 1,000 volts peak-to-peak.

The control circuit further preferably includes a buffer drive circuit generally indicated at 60 which is coupled between the circuit means and the transformer means. Buffer drive circuit 60 provides current gain and prevents the voltages developed by the transformer from having an adverse effect on the operation of the circuit means.

Another preferred feature of the control circuit of FIG. 1 relates to the provision of a remote control input 63. The reset input (P4) of integrated circuit 21 is connected to input 63. This enables the synchronization of the operation of control circuit of FIG. 1 to a remotely generated signal such as an audio signal. When this feature is employed, the remotely generated signal, when low, forces circuit 17 into a reset and thereby causes GCS to remain low. On the other hand, when it is high, circuit 17 generates GCS in a manner described above.

What is claimed is:

1. A d.c. powered control circuit for energizing a cold cathode lamp, the control circuit comprising:

an input to provide for application of d.c. power;

circuit means responsive to d.c. power applied to the input for generating a periodic signal defining a fundamental frequency of operation and including a pulsing phase and a static phase, the circuit means including digital circuit means operative during the pulsing phase to cause the periodic signal to define a plurality of consecutive pulses at a frequency substantially higher than the fundamental frequency;

an output for connection to the cold cathode lamp; and voltage step-up transformer means coupled between said circuit means and said output for providing a control signal to cause the cold cathode lamp to repeatedly reignite during the pulsing phase.

2. A control circuit according to claim 1, wherein the digital circuit means comprises a first, controllable astable multivibrator circuit having a gating control input and a multivibrator circuit output, and a second astable multivibrator circuit for supplying a gating control signal to the gating control input to cause the first astable multivibrator circuit to generate said periodic signal.

3. A control circuit according to claim 2, and further comprising a buffer circuit for coupling the periodic signal from the output of the first astable multivibrator circuit to the transformer means.

4. A control circuit according to claim 2, and further comprising manually operable mode selecting means to provide for selecting between at least first and second operating modes, the second astable multivibrator circuit being responsive to the mode selecting means to cause the gating control signal to define a first pulse repetition frequency in the first mode and a second different pulse repetition frequency in the second mode.

5. A multi-mode d.c. powered control circuit for energizing a cold cathode lamp, the control circuit comprising:

an input to provide for application of d.c. power;

manually operable mode selecting means to provide for selecting between a plurality of different operating modes;

an output for connection to the cold cathode lamp;

circuit means responsive to d.c. power applied to the input for generating a periodic signal defining a different fundamental frequency in each of said plurality of operating modes;

the circuit means including first and second astable multivibrator circuits, the first astable multivibrator circuit being controllable in response to a gating control signal supplied by the second astable multivibrator circuit, the second astable multivibrator circuit being responsive to the mode selecting means such that in a first one of the operating modes the gating control signal has a constant waveform and such that in each other operating mode the gating control signal has a pulse waveform with a pulse repetition frequency unique to the respective operating mode, the first astable multivibrator circuit being operative during the first operating mode under control of the constant waveform to cause the periodic signal to have a preselected pulse repetition frequency, and being operative in each other operating mode under control of the respective pulse waveform to cause the periodic signal to define a fundamental frequency with a pulsing phase and a static phase, with the periodic signal defining during the pulsing phase a plurality of consecutive pulses at said preselected pulse repetition frequency, and with the pulsing and static phases alternately occurring at the same fundamental frequency as the pulse repetition frequency of the waveform defined by the gating control signal; and voltage step-up transformer means coupled between said circuit means and said output for providing a control signal to cause the cold cathode lamp to repeatedly reignite at said preselected pulse repetition frequency.

* * * * *